US010471482B2

(12) United States Patent
Ritzer et al.

(10) Patent No.: US 10,471,482 B2
(45) **Date of Patent: *Nov. 12, 2019**

(54) EXHAUST APPARATUS, SYSTEM, AND METHOD FOR ENHANCED CAPTURE AND CONTAINMENT

(71) Applicant: OY HALTON GROUP LTD., Helsinki (FI)

(72) Inventors: Heinz Ritzer, Rettenschoess (AT); Fridolin Muehlberger, Reit im Winkl (DE); Andrey V. Livchak, Bowling Green, KY (US)

(73) Assignee: OY HALTON GROUP LTD., Helsinki (FI)

( * ) Notice: Subject to any disclaimer, the term of this patent is extended or adjusted under 35 U.S.C. 154(b) by 80 days.

This patent is subject to a terminal disclaimer.

(21) Appl. No.: 15/424,806

(22) Filed: Feb. 4, 2017

(65) Prior Publication Data

US 2017/0144201 A1 May 25, 2017

Related U.S. Application Data

(63) Continuation of application No. 12/988,487, filed as application No. PCT/US2009/041148 on Apr. 20, 2009, now Pat. No. 9,574,779.

(Continued)

(51) Int. Cl.

| | |
|---|---|
| ***B08B 15/02*** | (2006.01) |
| ***F24C 15/20*** | (2006.01) |
| ***F24F 13/08*** | (2006.01) |

(52) U.S. Cl.

CPC ..... *B08B 15/02* (2013.01); *F24C 15/2028* (2013.01); *F24C 15/2078* (2013.01); *F24F 13/08* (2013.01)

(58) Field of Classification Search

CPC .. F24C 15/20; F24C 15/2028; F24C 15/2078; B08B 15/02; F24F 13/08

(Continued)

(56) References Cited

U.S. PATENT DOCUMENTS

| | | |
|---|---|---|
| 2,743,529 A | 5/1956 | Hayes et al. |
| 2,833,615 A | 5/1958 | Kollgaard |

(Continued)

FOREIGN PATENT DOCUMENTS

| | | |
|---|---|---|
| AU | 1138776 | 9/1977 |
| AU | 3400697 A | 1/1998 |

(Continued)

OTHER PUBLICATIONS

Communication of Letter from Opponent, dated Apr. 4, 2012, in European Patent Application No. 20050775069 with English translation.

(Continued)

*Primary Examiner* — Steven B McAllister
*Assistant Examiner* — Allen R Schult
(74) *Attorney, Agent, or Firm* — Potomac Law Group, PLLC; Mark Catan

(57) ABSTRACT

An exhaust system includes a ventilated ceiling component with multiple surfaces and recesses. Each recess has an exhaust intake, the recesses being distributed over an area of a ceiling that has a perimeter adjacent the recesses. The perimeter has a jet register located below the exhaust intake and configured to generate jets, a first of the jets being directed toward and located below at least one of the exhaust intakes and a second of the jets being directed substantially vertically downward. The perimeter further has a displacement ventilation register.

10 Claims, 5 Drawing Sheets

Related U.S. Application Data

(60) Provisional application No. 61/046,257, filed on Apr. 18, 2008.

(58) Field of Classification Search
USPC ..... 454/61
See application file for complete search history.

(56) References Cited

U.S. PATENT DOCUMENTS 2,853,367 A 9/1958 Berton et al.
2,862,095 A 11/1958 Scofield
2,933,080 A 4/1960 Adey
3,332,676 A 7/1967 Namy
3,400,649 A 9/1968 Jensen
3,457,850 A 7/1969 Sweet et al.
3,513,766 A 5/1970 Ahlrich
3,536,457 A 10/1970 Henderson
3,583,306 A 6/1971 Hagdorn
3,829,285 A 8/1974 Beck
3,943,836 A 3/1976 Kuechler
3,952,640 A 4/1976 Kuechler
3,978,777 A 9/1976 Nett
4,043,319 A 8/1977 Jensen
4,047,519 A 9/1977 Nett
4,050,368 A 9/1977 Eakes
4,056,877 A 11/1977 Kuechler
4,085,736 A 4/1978 Kuechler
4,109,641 A 8/1978 Hunzicker
4,113,439 A 9/1978 Ookubo et al.
4,117,333 A 10/1978 Mueller
4,127,106 A 11/1978 Jensen
4,134,394 A 1/1979 Otenbaker
4,138,220 A 2/1979 Davies et al.
4,143,645 A * 3/1979 Blumberg ..... F24C 15/20 126/299 D
4,143,646 A * 3/1979 Sampsel ..... H05B 6/6423 126/299 D
4,146,017 A 3/1979 Overton
4,147,502 A 4/1979 Milton
4,153,044 A 5/1979 Nett
4,211,154 A 7/1980 Eakes
4,213,947 A 7/1980 Fremont et al.
4,286,572 A * 9/1981 Searcy ..... F24C 15/20 126/299 D
4,346,692 A 8/1982 McCauley
4,346,962 A 8/1982 Holmes
4,373,507 A 2/1983 Schwartz et al.
4,397,226 A 8/1983 Lind
4,407,266 A * 10/1983 Molitor ..... F24C 15/20 126/299 D
4,462,387 A 7/1984 Welsh
4,467,782 A 8/1984 Russell
4,475,534 A * 10/1984 Moriarty ..... F24C 15/2028 126/299 D
4,483,316 A 11/1984 Fritz et al.
4,484,563 A 11/1984 Fritz et al.
4,497,242 A 2/1985 Moyer
4,553,992 A 11/1985 Boissinot et al.
4,556,046 A 12/1985 Riffel et al.
4,586,486 A 5/1986 Kaufman
4,617,909 A 10/1986 Molitor
4,655,194 A 4/1987 Wooden
4,700,688 A * 10/1987 Searcy ..... F24C 15/20 126/299 D
4,706,553 A 11/1987 Sharp et al.
4,753,218 A 6/1988 Potter
4,773,311 A 9/1988 Sharp
4,788,905 A 12/1988 Kohorn
4,811,724 A 3/1989 Aalto et al.
4,856,419 A 8/1989 Imai
4,872,892 A 10/1989 Vartiainen et al.
4,896,657 A * 1/1990 Glassman ..... F24C 15/20 126/299 D
4,903,685 A 2/1990 Melink
4,903,894 A 2/1990 Pellinen et al.
4,944,283 A 7/1990 Tsuchiya et al.
4,944,285 A * 7/1990 Glassman ..... F24C 15/20 126/299 D
5,042,456 A 8/1991 Cote
5,050,581 A 9/1991 Roehl-Hager et al.
5,063,834 A 11/1991 Aalto et al.
5,215,075 A 6/1993 Caridis et al.
5,220,910 A 6/1993 Aalto et al.
5,251,608 A 10/1993 Cote
5,311,930 A 5/1994 Bruenn
5,312,296 A * 5/1994 Aalto ..... E04B 9/02 126/299 R
5,522,377 A 6/1996 Fritz
5,580,535 A 12/1996 Hoke et al.
5,622,100 A 4/1997 King et al.
5,657,744 A 8/1997 Vianen
5,716,268 A * 2/1998 Strongin ..... B08B 15/02 454/189
D407,473 S * 3/1999 Wimbock ..... D23/328
5,882,254 A 3/1999 Jacob
6,044,838 A * 4/2000 Deng ..... F24C 15/2028 126/299 D
6,058,929 A 5/2000 Fritz
6,089,970 A 7/2000 Feustel
6,170,480 B1 1/2001 Melink et al.
6,173,710 B1 1/2001 Gibson et al.
6,252,689 B1 6/2001 Sharp
6,336,451 B1 1/2002 Röhl-Hager et al.
6,347,626 B1 2/2002 Yi
6,428,408 B1 * 8/2002 Bell ..... B01L 1/50 454/56
6,450,879 B1 9/2002 Suen
6,752,144 B1 6/2004 Lee
6,846,236 B2 1/2005 Gregoricka
6,851,421 B2 2/2005 Livchak et al.
6,869,468 B2 3/2005 Gibson
6,878,195 B2 4/2005 Gibson
6,899,095 B2 5/2005 Livchak et al.
6,920,874 B1 7/2005 Siegel
7,048,199 B2 5/2006 Melink
7,147,168 B1 12/2006 Bagwell et al.
7,318,771 B2 1/2008 Huang et al.
7,364,094 B2 4/2008 Bagwell et al.
8,038,515 B2 * 10/2011 Livchak ..... F24C 15/20 126/299 D
8,444,462 B2 5/2013 Livchak et al.
2003/0146082 A1 8/2003 Gibson et al.
2003/0162491 A1 * 8/2003 Kanaya ..... F24C 15/20 454/252
2004/0011349 A1 * 1/2004 Livchak ..... F24C 15/20 126/299 D
2004/0035411 A1 * 2/2004 Livchak ..... F15D 1/02 126/299 R
2005/0000509 A1 * 1/2005 Carter ..... F24C 15/20 126/299 D
2005/0115557 A1 6/2005 Meredith et al.
2005/0229922 A1 10/2005 Magner et al.
2005/0279845 A1 12/2005 Bagwell et al.
2006/0032492 A1 * 2/2006 Bagwell ..... F15D 1/02 126/299 R
2006/0060187 A1 * 3/2006 Luddy ..... F24C 15/20 126/299 D
2006/0219235 A1 10/2006 Bagwell et al.
2007/0015449 A1 * 1/2007 Livchak ..... B08B 15/02 454/61
2007/0023349 A1 2/2007 Kylionen et al.
2007/0068509 A1 3/2007 Bagwell et al.
2007/0084459 A1 * 4/2007 Heinonen ..... F24C 15/20 126/299 D
2007/0184771 A1 8/2007 Fluhrer
2007/0202791 A1 * 8/2007 Lee ..... B08B 15/02 454/49
2007/0272230 A9 11/2007 Meredith et al.
2008/0045132 A1 2/2008 Livchak et al.
2008/0207109 A1 8/2008 Bagwell et al.
2008/0302247 A1 12/2008 Magner et al.

(56) References Cited

U.S. PATENT DOCUMENTS

| | | | |
|---|---|---|---|
| 2008/0308088 | A1 | 12/2008 | Livchak et al. |
| 2009/0093210 | A1 | 4/2009 | Livchak et al. |
| 2009/0199844 | A1 | 8/2009 | Meredith et al. |

FOREIGN PATENT DOCUMENTS

| | | | |
|---|---|---|---|
| AU | 2933601 | A | 7/2001 |
| BE | 838829 | A | 6/1976 |
| CA | 1054430 | A1 | 5/1979 |
| CA | 1069749 | A2 | 1/1980 |
| CA | 1081030 | A2 | 7/1980 |
| CA | 1177306 | A1 | 11/1984 |
| CA | 2536332 | A1 | 3/2005 |
| CH | 682512 | A | 9/1993 |
| DE | 1679545 | | 3/1971 |
| DE | 267301 | C2 | 9/1976 |
| DE | 2659736 | A1 | 7/1977 |
| DE | 3144777 | A1 | 5/1983 |
| DE | 3519189 | A1 | 12/1986 |
| DE | 4120175 | A1 | 2/1992 |
| DE | 4114329 | A1 | 11/1992 |
| DE | 4203916 | C1 | 4/1993 |
| DE | 19613513 | A1 | 10/1997 |
| DE | 19911850 | A1 | 9/2000 |
| DE | 10127679 | A1 | 1/2003 |
| EP | 0401583 | B1 | 12/1990 |
| EP | 0753706 | A1 | 1/1997 |
| EP | 0881935 | A1 | 12/1998 |
| EP | 1250556 | A1 | 10/2002 |
| EP | 1637810 | A1 | 3/2006 |
| EP | 1778418 | A2 | 5/2007 |
| FI | 58971 | B | 1/1981 |
| FR | 2008451 | A1 | 1/1970 |
| FR | 2301778 | B1 | 9/1976 |
| FR | 2635579 | B1 | 2/1990 |
| FR | 2705766 | A1 | 12/1994 |
| GB | 1544445 | A | 4/1979 |
| GB | 2132335 | A | 7/1984 |
| HK | 1019417 | | 2/2000 |
| JP | S51132645 | U | 11/1976 |
| JP | 60213753 | | 10/1985 |
| JP | 63091442 | | 4/1988 |
| JP | 1988063183 | | 4/1988 |
| JP | 63251741 | | 10/1988 |
| JP | 10084039 | | 3/1989 |
| JP | H02109956 | U | 9/1990 |
| JP | 32047937 | | 11/1991 |
| JP | 40000140 | | 1/1992 |
| JP | 40062347 | | 2/1992 |
| JP | 40068242 | | 3/1992 |
| JP | 41013143 | | 4/1992 |
| JP | 52048645 | | 9/1993 |
| JP | 1974069255 | | 9/1994 |
| JP | H06073636 | | 10/1994 |
| JP | 1995214327 | | 8/1995 |
| JP | H07214327 | A | 8/1995 |
| JP | 1996094140 | | 4/1996 |
| JP | 10288371 | | 10/1998 |
| JP | 11514734 | | 12/1999 |
| JP | 2000081216 | A | 3/2000 |
| JP | 2001165483 | A | 6/2001 |
| JP | 2002089859 | A | 3/2002 |
| JP | 2002139234 | A | 5/2002 |
| JP | 2003519771 | A | 6/2003 |
| JP | 2003269770 | A | 9/2003 |
| JP | 2004028493 | A | 1/2004 |
| JP | 2005214584 | A | 8/2005 |
| JP | 2006329496 | A | 12/2006 |
| JP | 2008070049 | A | 3/2008 |
| KR | 20060007715 | A | 1/2006 |
| NL | 7601862 | A | 2/1976 |
| SE | 7602168 | | 8/1976 |
| SE | 7904443 | | 11/1980 |
| WO | 1986006154 | A1 | 10/1986 |
| WO | 1997048479 | A1 | 12/1997 |
| WO | 2001051857 | A1 | 7/2001 |
| WO | 2001084054 | A1 | 11/2001 |
| WO | 2002014728 | A1 | 2/2002 |
| WO | 2002014746 | A1 | 2/2002 |
| WO | 2003056252 | A1 | 7/2003 |
| WO | 2005019736 | A1 | 3/2005 |
| WO | 2005114059 | A2 | 12/2005 |
| WO | 2006002190 | A2 | 1/2006 |
| WO | 2006012628 | A2 | 2/2006 |
| WO | 2006074420 | A2 | 7/2006 |
| WO | 2006074425 | A1 | 7/2006 |
| WO | 2007121461 | A2 | 10/2007 |
| WO | 2008157418 | A1 | 12/2008 |
| WO | 2009092077 | A1 | 7/2009 |
| WO | 2009129539 | A1 | 10/2009 |

OTHER PUBLICATIONS

Communication of Notice of Opposition dated May 4, 2011 in European Patent Application No. 20050775069 with English translation of Statement of Grounds.

Examination Report dated Aug. 6, 2013, in counterpart Australian Patent Application No. 2009237572.

Examination Report dated Feb. 24, 2016, in counterpart Australian Patent Application No. 2014271273.

Extended European Search Report and Search Opinion dated Sep. 4, 2014, in European Pat. Appln No. 14169406.7.

Extended European Search Report and Search Opinion dated Mar. 11, 2011, in European Patent Application No. 09 73 2140.

Faltsi-Saravelou et al., "Detailed Modeling of a Swirling Coal Flame," Combustion Science and Technology, 1997, 123:pp. 1-22.

Halton drawings, "Model KVL Fryer Hood", Nov. 18, 1998.

Halton drawings, "Model KVL Kitchen Hood Layout", Sep. 21, 1998.

Interlocutory Decision in Opposition Proceedings, dated Feb. 18, 2013, in European Patent No. 1,778,418.

Letter from Opponent, dated Dec. 20, 2012, in European Patent No. 1 778 418 with English translation.

Minutes of the Oral Proceedings of the Opposition Division, dated Feb. 18, 2013, in European Patent No. 1,778,418.

Morsi et al., "An Investigation of Particle Trajectories in Two-Phase Flow Systems," Journal of Fluid Mechanics, 1972, 55:pp. 193-208.

Non-final Office Action, dated May 23, 2010, for U.S. Appl, No. 12/407,686.

Office Action dated Aug. 26, 2014, in Mexican Patent Application No. MX/A/2010/011363.

Office Action dated Jan. 2, 2014, in counterpart European Patent Application No. 09732140.0.

Office Action dated Jun. 13, 2013, in Mexican Patent Application No. MX/a/2010/011363.

Office Action dated Oct. 29, 2013, in counterpart Japanese Patent Application No. 2011-505255.

Office Action dated Oct. 8, 2013, in related U.S. Appl. No. 13/763,167.

Office Action in Japanese Patent Application No. JP2014-036914 dated Mar. 3, 2015 with English translation.

Office Action in Korean Patent Application No. 2010-7025369 dated Mar. 18, 2015 with English translation.

Office Action dated Apr. 12, 2012, in Chinese Patent Application No. 200980118055.X.

Office Action dated Apr. 22, 2016 in Canadian Patent Application No. 2,721,763.

Office Action dated Apr. 9, 2013, in Japanese Patent Application No. 2011-505255.

Office Action issued in European Patent Application No. 14169406.7 dated Aug. 23, 2016.

Office Action dated Jun. 5, 2015, in Canadian Patent Application No. 2,721,763.

Office Communication dated Mar. 20, 2013, in European Patent Application No. 09732140.

Official Action dated Sep. 12, 2013, in counterpart Mexican Patent Application No. MX/A/2010/011363.

Prosecution history of U.S. Appl. No. 07/010,277, now U.S. Pat. No. 4,811,724.

(56) References Cited

OTHER PUBLICATIONS

Summary for GIDASPOW, D., Multiphase Flow and Fluidization: Continuum and Kinetic Theory Descriptions, Academic Press, 1994.
Summary for Lumley et al., A First Course of Turbulence, Massachusetts Institute of Technology, 1972.
Summons to Attend Oral Proceedings including Annex to Invitation, dated Aug. 2, 2012, for Opposition in European Patent Application No. 2005775069.
Translation of foreign patent document DE 4203919.
Written Opinion of the International Searching Authority for International Patent Application No. PCT/US05/26378.
Examination Report issued for Indian Patent Application No. 7961/DELNP/2010 dated Mar. 1, 2018.

* cited by examiner

EXHAUST APPARATUS, SYSTEM, AND METHOD FOR ENHANCED CAPTURE AND CONTAINMENT

CROSS-REFERENCE TO RELATED APPLICATIONS

This application is a continuation of U.S. patent application Ser. No. 12/988,487 filed Nov. 18, 2010, which is a U.S. national stage entry under 35 U.S.C. § 371 of International Application No. PCT/US2009/041148 filed Apr. 20, 2009, which claims the benefit of U.S. Provisional Application No. 61/046,257 filed Apr. 18, 2008, the contents of which are incorporated herein by reference in their entireties.

BACKGROUND

Exhaust devices, such as exhaust hoods and ventilated ceilings, are used to remove pollutants from occupied spaces with sources of pollutants. Examples include factories, kitchens, workshops, and food courts which contain industrial processes, kitchens appliances, tools, and portable cooking appliances, respectively. Preferably, exhaust hoods remove pollutants by drawing them from a collection area near the source and may also provide a containment function, usually by ensuring that the velocity of exhaust is sufficient near the source to overcome any local buoyancy or draft effects to ensure that all pollutants are prevented from escaping to the general occupied space. By managing transients in this way, an effective capture zone is provided.

In exhaust systems, an exhaust blower creates a negative pressure zone to draw pollutants and air directly away from the pollutant source. In kitchen applications, the exhaust generally draws pollutants, including room-air, through a filter and out of the kitchen through a duct system. A variable speed fan may be used to adjust the exhaust flow rate to match the extant requirements for capture and containment. That is, depending on the rate by which the effluent is created and the buildup of effluent near the pollutant source, the speed of exhaust blower may be manually set to minimize the flow rate at the lowest point which achieves capture and containment.

The exhaust rate required to achieve full capture and containment is governed by the highest transient load pulses that occur. This requires the exhaust rate to be higher than the average volume of effluent (which is inevitably mixed with entrained air). Such transients can be caused by gusts in the surrounding space and/or turbulence caused by plug flow (the warm plume of effluent rising due to buoyancy). Thus, for full capture and containment, the effluent must be removed through the exhaust blower operating at a high enough speed to capture all transients, including the rare pulses in exhaust load. Providing a high exhaust rate—a brute force approach—is associated with energy loss since conditioned air must be drawn out of the space in which the exhaust hood is located. Further, high volume operation increases the cost of operating the exhaust blower and raises the noise level of the ventilation system.

Also known are "make up" air systems, some of which have been proposed to be combined with exhaust hoods in a manner in which make-up air is propelled toward the exhaust intake of a hood. This "short circuit" system involves an output blower that supplies and directs one, or a combination of, conditioned and unconditioned air toward the exhaust hood and blower assembly. Such "short circuit" systems have not proven to reduce the volume of conditioned air needed to achieve full capture and containment under a given load condition.

Another solution in the prior art is described in U.S. Pat. No. 4,475,534 titled "Ventilating System for Kitchen." In this patent, the inventor describes an air outlet in the front end of the hood that discharges a relatively low velocity stream of air downwardly. According to the description, the relatively low velocity air stream forms a curtain of air to prevent conditioned air from being drawn into the hood. In the invention, the air outlet in the front end of the hood assists with separating a portion of the conditioned air away from the hood. Other sources of air directed towards the hood create a venturi effect, as described in the short circuit systems above. As diagramed in the figures of the patent, the exhaust blower must "suck up" air from numerous air sources, as well as the effluent-laden air. Also the use of a relatively low velocity air stream necessitates a larger volume of air flow from the air outlet to overcome the viscous effects that the surrounding air will have on the flow.

In U.S. Pat. No. 4,346,692 titled "Make-Up Air Device for Range Hood," the inventor describes a typical short circuit system that relies on a venturi effect to remove a substantial portion of the effluent. The patent also illustrates the use of diverter vanes or louvers to direct the air source in a downwardly direction. Besides the problems associated with such short circuit systems described above, the invention also utilizes vanes to direct the air flow of the output blower. The use of vanes with relatively large openings, through which the air is propelled, requires a relatively large air volume flow to create a substantial air velocity output. This large, air volume flow must be sucked up by the exhaust blower, which increases the rate by which conditioned air leaves the room. The large, air volume flow also creates large scale turbulence, which can increase the rate by which the effluent disperses to other parts of the room.

Currently, in workplaces where fumes, dust, or chemical vapors present a hazard, local exhaust ventilation devices are used to prevent workers from inhaling contaminated air. Generally, an exterior exhaust hood, for example, a receiving hood, is disposed above the emission source to remove airborne contaminants. However, theoretical capture efficiency of such a receiving hood holds only in still air, the capture efficiency decreases due to crosswind in the surrounding environment, no matter how weak the crosswind is. To control the adverse effect of crosswind, a fume hood having a back panel, two side panels, and a hood sash in the front has been designed to replace a receiving hood. However, the side panels and hood sash of a fume hood limit the size of operation space for operators' upper limbs. Therefore, how to eliminate the adverse effect of crosswind, and meanwhile retain the freedom of operators' upper limbs, becomes a key topic to a receiving hood.

In order to accomplish the key topic, U.S. Pat. No. 4,788,905, published on Dec. 6, 1988, disclosed a combination cooking, heating and ventilating system. The system contains an open fire grill surrounded by an unperforated griddle, both of which are surrounded by an eating counter. A fan is positioned below the cooking grill and griddle which forces the air upward between the eating counter and the griddle in the shape of an air curtain for removing hot smoking air from the cooking area. However, due to the limited size, the fan is not applicable in a large-scale worktable. Further, generally speaking, there is not necessarily enough space to accommodate the fan device below the worktable.

U.S. Pat. No. 5,042,456, published on Aug. 27, 1991, disclosed an air canopy ventilation system. The system comprises a surface having two substantially parallel spaced apart side panels surmounted at their respective upper edges by a canopy. A vent means having a plurality of outlets extends between the side panels and substantially the whole length of the front edge of the surface. A fan means connected to the vent means is adapted to drive a flow of air through the vent means upwardly to form a curtain of air over the front of the system, thereby entraining within the area fumes and odors. The upwardly flowing air, fumes and odors are removed by an exhaust means. Though the system can solve the problem of the lateral diffusion of the smoke and the influence of the crosswind, the air flow perpendicular to the side panel affects the efficiencies of the upward air curtain and canopy. Meanwhile, the structure of the system having the side panel and back panel limits the size of the operation space in which the operator can operate.

Further, U.S. Pat. No. 6,450,879, published on Sep. 17, 2002, disclosed an air curtain generator includes a casing with a fan received therein so as to blow an air curtain from opening of the casing, and the air curtain separates the workers and the source where generates contaminated air. However, the air curtain only isolates the smoke from laterally diffusing towards the operator, but does not isolate the smoke from diffusing towards the side without the air curtain generator. Additionally, the inventor of the present invention disclosed an air curtain generator in U.S. Pat. No. 6,752,144 published on Jun. 22, 2004, and the present invention is a continued invention along the lines of this patent.

In U.S. Pat. No. 6,851,421, an exhaust hood has a vertical curtain jet which helps to prevent the escape of pollutants in the vicinity of the source. U.S. Pat. Nos. 4,811,724 and 5,220,910 describe a canopy type exhaust hood with a horizontal jet to enhance capture. In one the latter, general ventilation air is provided on a side face of the canopy hood. U.S. Pat. No. 5,063,834 describes a system in which a ceiling-level ventilation zone is created to remove unducted fumes from exhaust hoods. U.S. Pat. No. 4,903,894 describes displacement ventilation techniques in which ventilation air is brought into a conditioned space at low velocity and without mixing to capture impurities and convey them toward a removal zone near the ceiling. U.S. Pat. No. 5,312,296 describes an exhaust hood that is located near the ceiling with an exhaust intake jutting from the ceiling level. Ventilation air enters the occupied space via a horizontal jet that runs along the ceiling level and a displacement ventilation registers that distributes air at low (non-mixing) velocities.

SUMMARY

According to an embodiment, an exhaust device has a housing having an aspect ratio of at least ten. The housing has surfaces defining at least one recess having an exhaust intake. The housing has a perimeter adjacent the at least one recess having a jet register located below the exhaust intake and configured to generate jets, a first of the jets being directed toward the exhaust intake and located below it and a second of the jets being directed substantially vertically downward. The lower edges of a portion of the housing contains the exhaust intake and portions of the housing containing the jet register being substantially vertically aligned. The surfaces defining each of the at least one recess forms a piecewise arcuate continuous surface with a light source located adjacent the jet register. The exhaust intake defines a linear horizontal intake area, at least one portion of which is covered by a removable blank. The jet register has directable nozzles forming the first of the jets that are aimed at the exhaust intake areas not covered by the removable blank. Note that the nozzles can be replaced by discharge vents with movable vanes or sliding damper elements. The first of the jets terminates at or immediately short of the exhaust intake. The second of the jets terminates above approximately 1.8 meters above a floor level. A fume source is located below the housing with an edge of the fume source being positioned to form at least a 20 degree angle from the vertical with the jet register such that all of the fume source lies below the at least one recess. A control system is configured to control at least the volume flow rate of the second of the jets responsively to real time measured draft conditions in a space in which the housing is located. The control system may be configured to control the first of the jets responsively to real time measured draft conditions in a space in which the housing is located. A general ventilation register may be located adjacent the jet register, the general ventilation register directing ventilation air downwardly at non-mixing velocities. The jet register may be configured to surround the housing perimeter. The first and second of the jets may be supplied from a common plenum. The first and second of the jets may be supplied from separate plenums which are supplied by air sources at separately controlled flow rates.

According to another embodiment, an exhaust device has a housing having an aspect ratio of at least ten. The housing may have surfaces defining at least one recess having an exhaust intake. The housing may have a perimeter adjacent the at least one recess having a jet register located below the exhaust intake and configured to generate jets with a first of the jets being directed toward the exhaust intake and located below it and a second of the jets being directed substantially vertically downward. Preferably, lower edges of a portion of the housing contain the exhaust intake and portion of the housing containing the jet register are substantially vertically aligned. Preferably, the surfaces defining each of the at least one recess form a piecewise arcuate continuous surface with a light source located adjacent the jet register. Preferably, the exhaust intake defines a linear horizontal intake area, at least one portion of which is covered by a removable blank. The jet register may have directable nozzles forming the first of the jets that are aimed at the exhaust intake areas not covered by the removable blank. The first of the jets terminates at or immediately short of the exhaust intake. Preferably, the second of the jets terminates above approximately 1.8 meters above a floor level. Preferably, a fume source is located below the housing with an edge of the fume source being positioned to form at least a 20 degree angle from the vertical with the jet register such that all of the fume source lies below the at least one recess. Preferably, a control system is configured to control at least the volume flow rate of the second of the jets responsively to real time measured draft conditions in a space in which the housing is located.

According to an embodiment, an exhaust device has a housing having an aspect ratio of at least ten. The housing has surfaces defining at least one recess having an exhaust intake. The housing has a perimeter adjacent the at least one recess having a jet register located below the exhaust intake and configured to generate jets, a first of the jets being directed toward the exhaust intake and located below it and a second of the jets being directed substantially vertically downward. The lower edges of a portion of the housing contains the exhaust intake and portions of the housing containing the jet register being substantially vertically aligned. The surfaces defining each of the at least one recess forms a piecewise arcuate continuous surface with a light source located adjacent the jet register. The first of the jets terminates at or immediately short of the exhaust intake. The second of the jets terminates above approximately 1.8 meters above a floor level. A fume source is located below the housing with an edge of the fume source being positioned to form at least a 20 degree angle from the vertical with the jet register such that all of the fume source lies below the at least one recess. The control system may be configured to control the first of the jets responsively to real time measured draft conditions in a space in which the housing is located. A general ventilation register may be located adjacent the jet register, the general ventilation register directing ventilation air downwardly at non-mixing velocities. The jet register may be configured to surround the housing perimeter. The first and second of the jets may be supplied from a common plenum. The first and second of the jets may be supplied from separate plenums which are supplied by air sources at separately controlled flow rates.

BRIEF DESCRIPTION OF DRAWINGS

The accompanying drawings, which are incorporated herein and constitute part of this specification, illustrate exemplary embodiments of the invention, and, together with the general description given above and the detailed description given below, serve to explain the features of the invention.

DESCRIPTION OF EMBODIMENTS

The efficiency of exhaust systems that employ ventilated ceiling systems, where the exhaust intake is located at the ceiling level, is particularly challenging. The capture efficiency of the system must be assured to prevent the spreading of impurities throughout the conditioned space. It has been shown that the efficiency of the exhaust system can be improved with a horizontal jet near the ceiling surface. The air jet is projected horizontally across the ceiling, which helps to direct heat and air impurities towards the exhaust intake. Preferably, such jets have a volume flow rate that is only about 10% of the total supply air flow rate. In the ventilated ceiling, the jet may improve the total effectiveness of the ventilation system. With the horizontal jet, the average contaminant level in the occupied zone was shown to be 40% lower than one without and the estimated energy saving potential can be as high as 23%.

Figure 1:
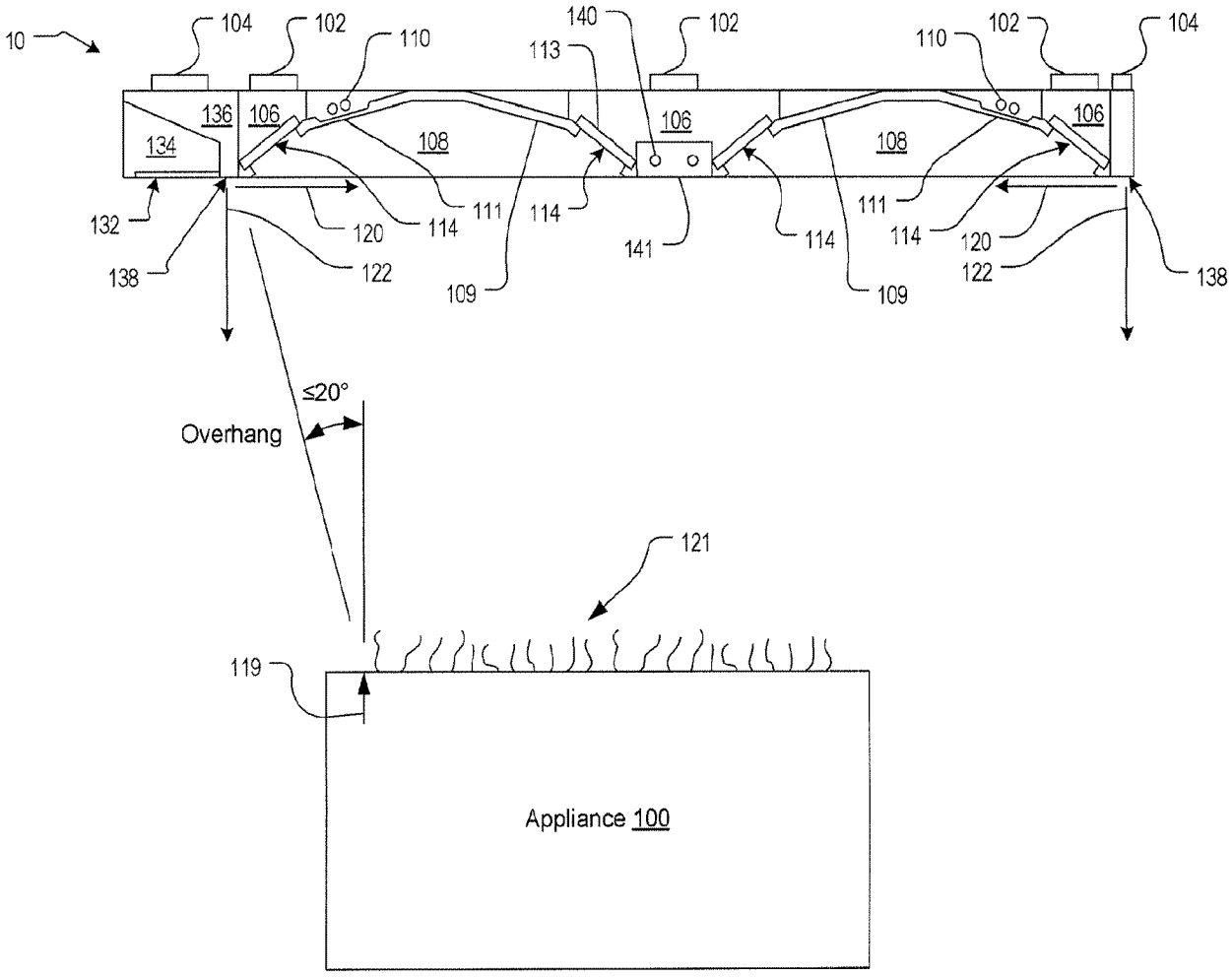
FIG. 1 illustrates a side/section view of a lighting ventilation device (LVD) and fume source in a conditioned space.

A ventilated ceiling may have features similar to the devices shown in U.S. Pat. No. D407,473, filed Apr. 1, 1999 and shown and described in U.S. Pat. No. 5,312,296, filed Jan. 30, 1991, both of which are hereby incorporated herein. In an embodiment, the ventilation device of U.S. Pat. No. 5,312,296 is modified by including a vertical curtain jet register between the non-mixing ventilation register 17 and the horizontal jet register 15. The vertical curtain jet register in this embodiment has a velocity, thickness and breadth as to form a continuous curtain jet that terminates at about the height of the head of a worker, or approximately 1.8 m above the floor when located in an interior space. In another embodiment, the device is modified by lifting the intake plenum 18 and dropping the ventilation registers such that a configuration similar to that of FIG. 1 is formed. Preferably, in this embodiment, a recess as indicated at 108 in FIG. 1 may be defined. The recess 108 may have one or more arching surfaces as indicated in FIG. 1 at 109.

Referring now to FIG. 1, which shows a preferred embodiment of a lighting-ventilation device (LVD) 10. A general ventilation register 132 receives air from a plenum 134 which may be supplied through a collar 104 shared with another plenum 136 or through a separate collar (not shown). The register 132 is preferably configured such that ventilation air, cooler than the ambient below the register, is provided at non-mixing velocities as is typical for displacement ventilation applications. The general ventilation register 132 may or may not be present. It may be on one side of the device 10, as shown, or on two or three sides, or it may completely encircle the LVD 10.

An additional combined vertical and horizontal jet register 138 emits air so as to form substantially vertical and substantially horizontal jets as indicated by arrows 122 and 120, respectively. The vertical and horizontal jets may be supplied via a plenum 136 (supplied through a collar 104) and may encircle, flank on two or three sides, or border on a single side, the LVD 10. The vertical and horizontal jets may be supplied by ventilation air, ambient air, or conditioned room air. Each may also be supplied from different ones of these sources of air. Preferably, the velocity of the horizontal jet 120 is such that it terminates approximately at the point where it would otherwise reach an exhaust intake 114, which preferably has a removable filter 113. Exhausted fumes and air are removed via plenums 106 and exhaust collars 102 which attach to suitable ductwork. Notwithstanding the name, "horizontal," the angle of the horizontal jet 120 may be aimed toward the center of the exhaust intake 114 or at some intermediate angle between such angle and the horizontal.

Unlike the device of U.S. Pat. No. 5,312,296, in the embodiment of FIG. 1, the intakes are relatively lowered and the origin of the horizontal jet register is lowered such as to form a low profile configuration with two recesses 108. This configuration has the benefit of placing the horizontal jet below the intake while retaining the low profile and pleasing appearance of a ventilated ceiling as illustrated U.S. Pat. No. D407,473. It also creates a shallow recess 108. Preferably diffusers or windows 111 are located in a surface 109 the recess 108 with lamps 110, for example fluorescent lamps located behind them such as to form a continuous that a smooth surface 109. Lights and diffusers 140 and 141 may also be located at a center between recesses 108. Note that in an alternative embodiment, only one of the horizontal 120 and vertical 122 jets are provided in combination with the configuration illustrated having the recess and the intake 114 located above the point where the jet register 138.

Preferably, the vertical and horizontal jets 122, 120 originate from approximately the same location (register 138) which coincides with a perimeter of the LVD 10. They do not need to be supplied from the same source of air nor do they need to originate from a common register structure. It is preferable, however that they both are positioned to form a 20° angle from the vertical and whose vertex is at the outermost edge of the pollution-generating part 121 of an appliance 100. Thus, lower appliances must be located more inwardly and higher appliances can be located more outwardly. This minimum angle may be reduced if the exhaust flow is increased or the jet flow rates are increased.

Preferably the horizontal jet has a velocity of 6 to 10 m/s and a volume flow rate per linear meter of 21 to 35 cm/hr per linear meter of the LVD 10 perimeter for a typical kitchen application. These approximately coincide with the throw conditions identified above. Preferably, the total volume rate of the vertical jets to the total volume rate of the horizontal jets is preferably about 0.25 to 0.35. These are not necessarily required values, but are representative for kitchen applications. A preferred aspect ratio of the exhaust device (e.g., W/Y indicated in FIG. 3) is greater than ten.

Figure 2A:
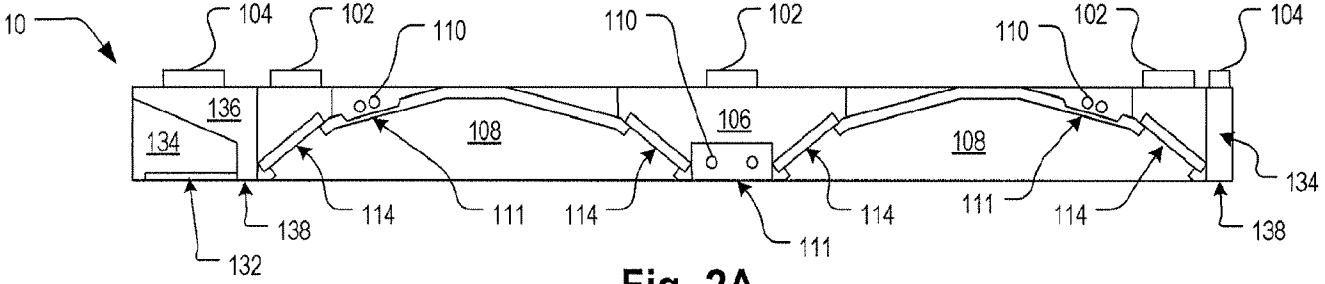
FIGS. 2A and 2B illustrate the LVD of FIG. 1 in section and bottom views.
Figure 2B:
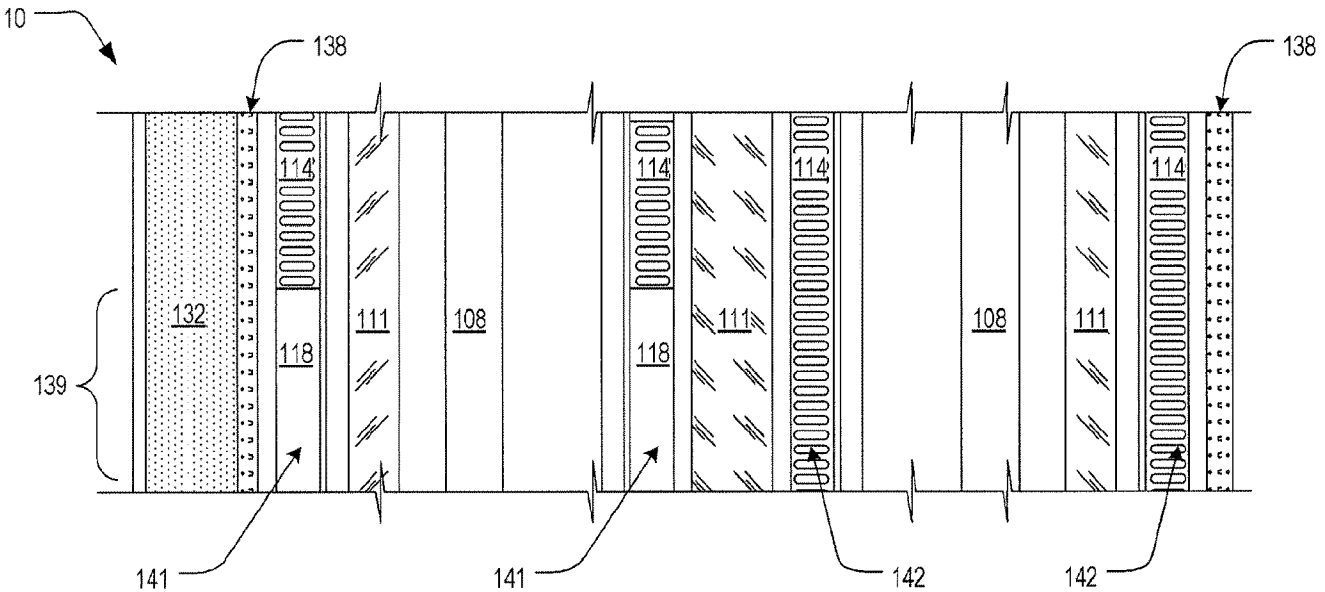

FIGS. 2A and 2B illustrate the LVD in section 2A and plan view (as viewed from underneath) 2B. Blanks 118 are fitted to portions of the intake lengths to prevent air and fumes from being drawn into portions 139 of the LVD. The blanks 118 may replace removable filter cartridges (not shown, but for example, impact-type grease filters or as shown in U.S. Pat. No. 4,872,892, filed Sep. 16, 1988). The blanks 118 permit the exhaust to be drawn in positions overlying the pollution sources. Preferably, they are used only over areas with no pollutions sources and permit an overhang of the open intakes 114 over each pollution source of at least 20 degrees as discussed above with reference to the overhang angle of FIG. 1.

Figure 3:
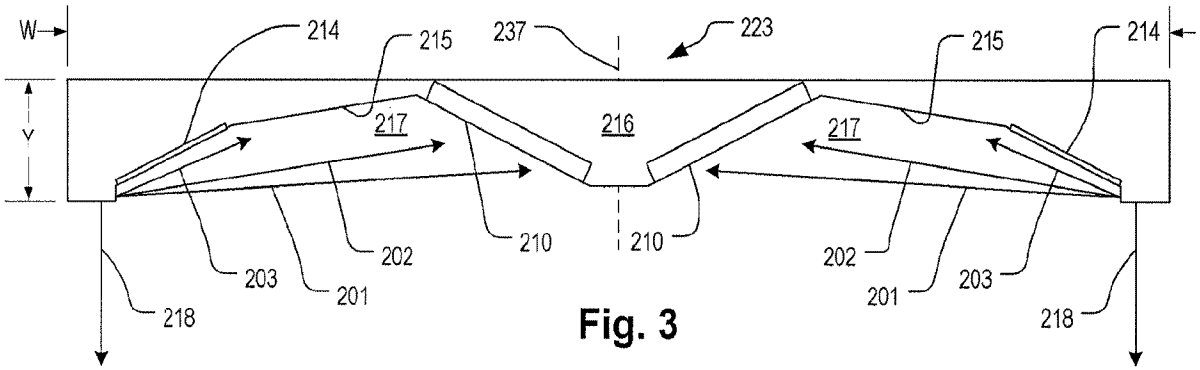
FIG. 3 illustrate another embodiment of an LVD.

Referring to FIG. 3, as discussed above, a horizontal jet may be provided which is aimed nearly horizontally as indicated at 201, slightly upwardly toward the center of the intake 210, as indicated at 202, or even more upwardly as indicated at 203 such that it flows along the recess 217 surface 215. A combination of these jets may be employed. In the embodiment of FIG. 3, a light diffuser, lamp cover, or lens 214 is located adjacent horizontal jet to help keep it clean such that the horizontal jet does double duty by helping to trap fumes (guide pollution-containing plumes) and keep the light cover 214 clean. A vertical jet 218 may also be provided. FIG. 3 also illustrates an embodiment with a recess 217 and which has the horizontal jet outlet located below the intake, but in which there is only one intake 210 connected to a common plenum 216 for each recess 217 on one side rather than two as in the prior embodiments. In an alternative embodiment, only one intake 210 and one recess 217 are provided in a configuration in which, preferably, a wall 237 bounds the intake side of the LVD 223.

Figure 4A:
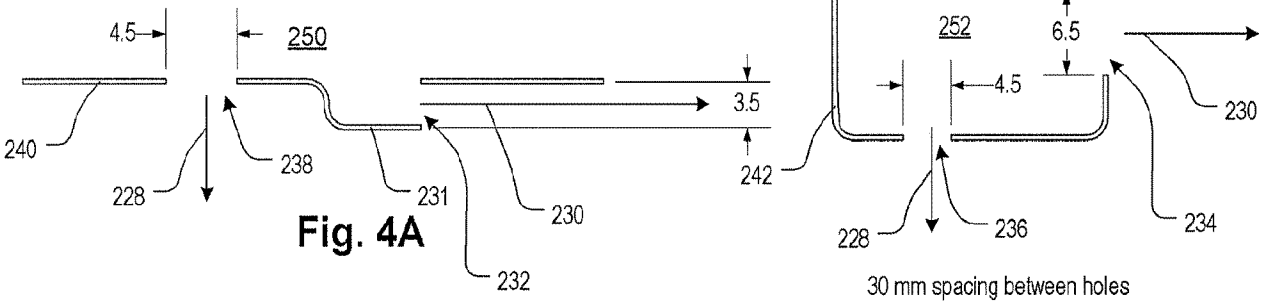
FIGS. 4A and 4B illustrate a portion of a horizontal and vertical jet register according to an embodiment.
Figure 4C:
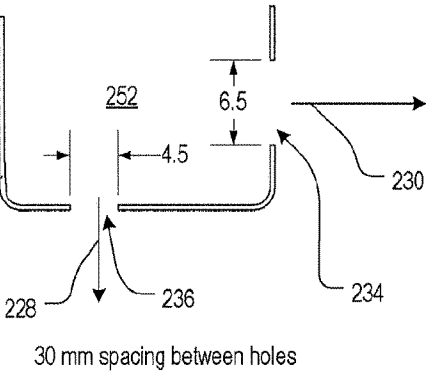
FIG. 4C illustrates a portion of a horizontal and vertical jet register according to another embodiment.
Figure 4B:
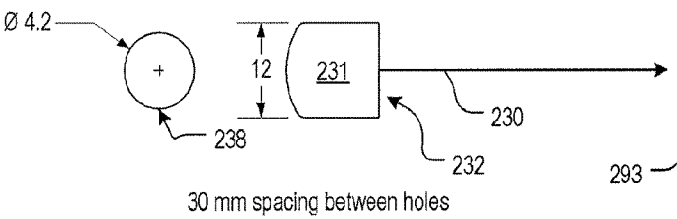

FIGS. 4A and 4B show a configuration for a common vertical and horizontal register fed from a plenum 250. FIG. 4A shows a section view and 4B shows a bottom view. A hole 238 generates the vertical jet 228. A nozzle 231 generates the horizontal jet 230. The nozzle 231 may be forged with the illustrated shape and an opening in a flat sheet of metal 240, which forms the shell of the plenum 250, at regular intervals. Examples of dimensions are shown. The opening 232 of the nozzle 231 may be 3.5 mm deep and 12 mm wide. The hole 238 may be 4.5 mm in diameter. The spacing between the jets/holes may be 30 mm. These dimensions are illustrative only. FIG. 4C shows in section another configuration of a jet register fed through a plenum 252 defined in a box-shaped extension 242. A hole 236 generates the vertical jet 228. Another hole 234 in the side of the box shaped extension 242 generates the horizontal jet 230. The holes may be formed at regular intervals along the register. Examples of dimensions are shown. The opening 234 may be 6.5 mm in diameter. The hole 236 may be 4.5 mm in diameter. The spacing between the jets/holes may be 30 mm. These dimensions are illustrative only.

Figure 4D:
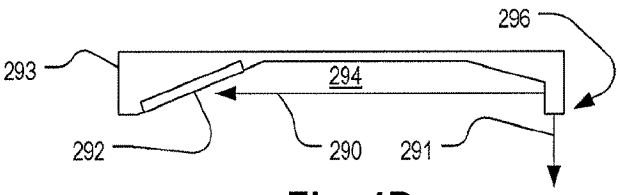
FIG. 4D illustrates a section view of an LVD in which the horizontal jet originates from a position that is not below the intake, in which there is no light fixture and in which the jet register is configured in accord with the embodiment of FIG. 4C, all of which are features that may be combined or substituted for any and all of the corresponding features of the other embodiments.

FIG. 4D illustrates a section view of an LVD 293 in which the horizontal jet 290 originates from a position that is not below the intake 292, in which there is no light fixture and in which the jet register 296 is configured in accord with the embodiment of FIG. 4C, all of which are features that may be combined or substituted for any and all of the corresponding features of the other embodiments. The LVD 293 contains a recess 294 defined within the jet register 296 which is substantially aligned with the bottom of the exhaust intake 292. A vertical jet 291 emanates from the jet register 296.

Figure 5:
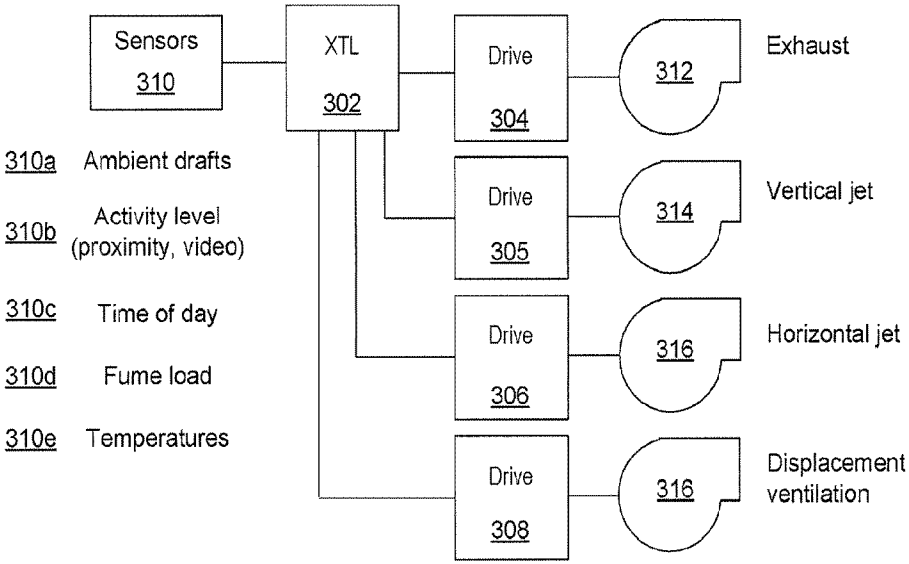
FIG. 5 illustrates features of a control system.

FIG. 5 shows a control system that may be used in connection with the embodiments. Sensors (which may include associate signal conditioning and data processing elements) 310 may include one or more of:

- air velocity sensors indicating the average or maximum velocities (or some other statistic) responsive to the movement of air in the conditioned space, which air movement affects the stability of a rising plume, such as drafts, air movement induced by movement of personnel, etc. identified as ambient drafts 310*a;*
- activity level sensors 310*b* responsive to the movement in the conditioned space that may cause air movement that can disrupt the plume including information extracted from event recognition in a video stream, activity from a proximity or infrared distance detector or range finder;
- time of day 310*c* from which the activity level may be inferred, such as in a production workspace such as a commercial kitchen;
- fume load 310*d* which may be indicated by means of a fuel usage indicator of a heat source such as a range or grill, a carbon dioxide detector, a temperature or moisture sensor or other composition sensor which may indicate the composition of a fume plume, a video stream-based event recognition device, for example one configured to recognize zero, light, medium, and heavy use of an appliance and the nature of the use; and
- temperatures 310*e* such as indoor, outdoor, and plume temperatures.

A controller 302 receives one or more sensor 310 signals and may control one or more outputs including drives 304-308 which control flow rates indicated by fan symbols 312-316. The drives 304-308 may be damper drives or speed drives or any device for controlling volume flow rate. The drive signals may control the exhaust rate, vertical jet flow rate, horizontal jet flow rate, and/or displacement ventilation flow rate. Any of these may be controlled separately or together (e.g., a common drive signal or a mechanical coupling in the control and mechanical aspects) according to various mechanical embodiments (such as one in which a shared plenum provides air for both the vertical and horizontal jets).

In an embodiment, the exhaust flow rate is preferably modulated responsively to the fume load and/or indicators of drafts or air movement in the conditioned space. The velocities of the vertical and/or horizontal jets may be modulated in response to such inputs as well. For example, when there is greater air movement in the conditioned space, such as caused by workers moving about, the exhaust velocity may be proportionately increased and the vertical jet speed may be increased proportionately as well.

Figure 7A:
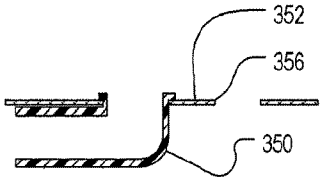
FIGS. 7A, 7B, and 7C illustrate an aimable horizontal jet nozzle.
Figure 7B:
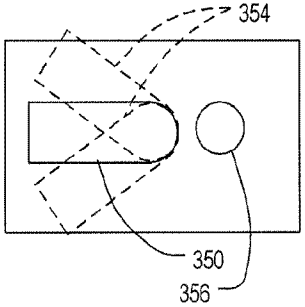
Figure 7C:
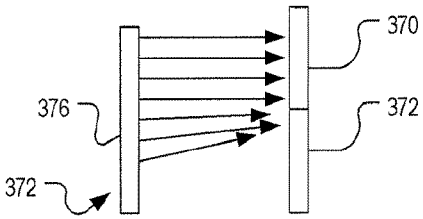
Figure 6:
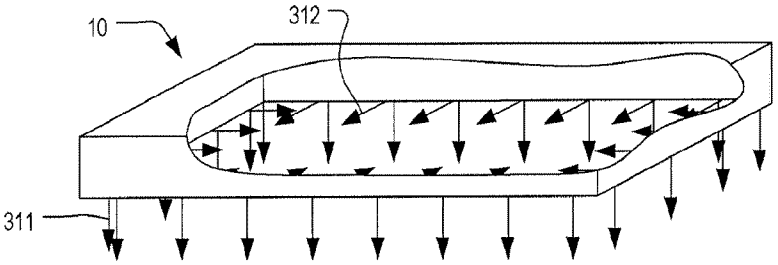
FIG. 6 illustrates an LVD with vertical and horizontal jets surrounding it on multiple sides.

FIG. 6 shows a perspective illustration of a configuration in which the vertical 311 and horizontal 312 jets run along an entire perimeter of a LVD 10. FIGS. 7A, 7B, and 7C illustrate an aimable horizontal jet nozzle 350. The nozzle 350, which may be a press-fitted plastic member. When a section of the LVD is fitted with blanks and therefore has zones without exhaust intakes, the aligned portions of horizontal and vertical jet registers may be tilted to direct certain ones 376 at a horizontal angle toward an adjacent intake section 370 and away from a section with a blank 372 as shown in FIG. 7C. For long blank sections 372, some of the horizontal jet outlets may be closed or plugged. The holes for the vertical jets 356 are also shown. Tilted positions 354 are shown. Any of the nozzles may also be substituted with a discharge vent with a movable vane and/or sliding damper blade.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

Although the LVDs shown including lighting components, these are not essential to all embodiments and any of the embodiment may be modified by their removal. The LVD structures may be configured as modular components that can be assembled to form various shapes to cover pollution sources in various arrangements in a production space. Blanks that cover exhaust intakes may be provided as part of a kit and used to redefine the exhaust intake coverage as a production space is modified by the replacement, removal, or rearrangement of pollutions sources. Control adjustments discussed above may be done manually as well as automatically. The LVD embodiments may be surface mounted or recessed into a ceiling or false ceiling. General ventilation registers may be located at all sides of an LVD or only some sides. General ventilation registers may be located adjacent or remotely from the LVD. Note also that although the vertical and horizontal jets in the embodiments described are single point jets forming linear arrays, in alternative embodiments, the jets may be formed as slots to form vertical and horizontal curtains.

Figure 8:
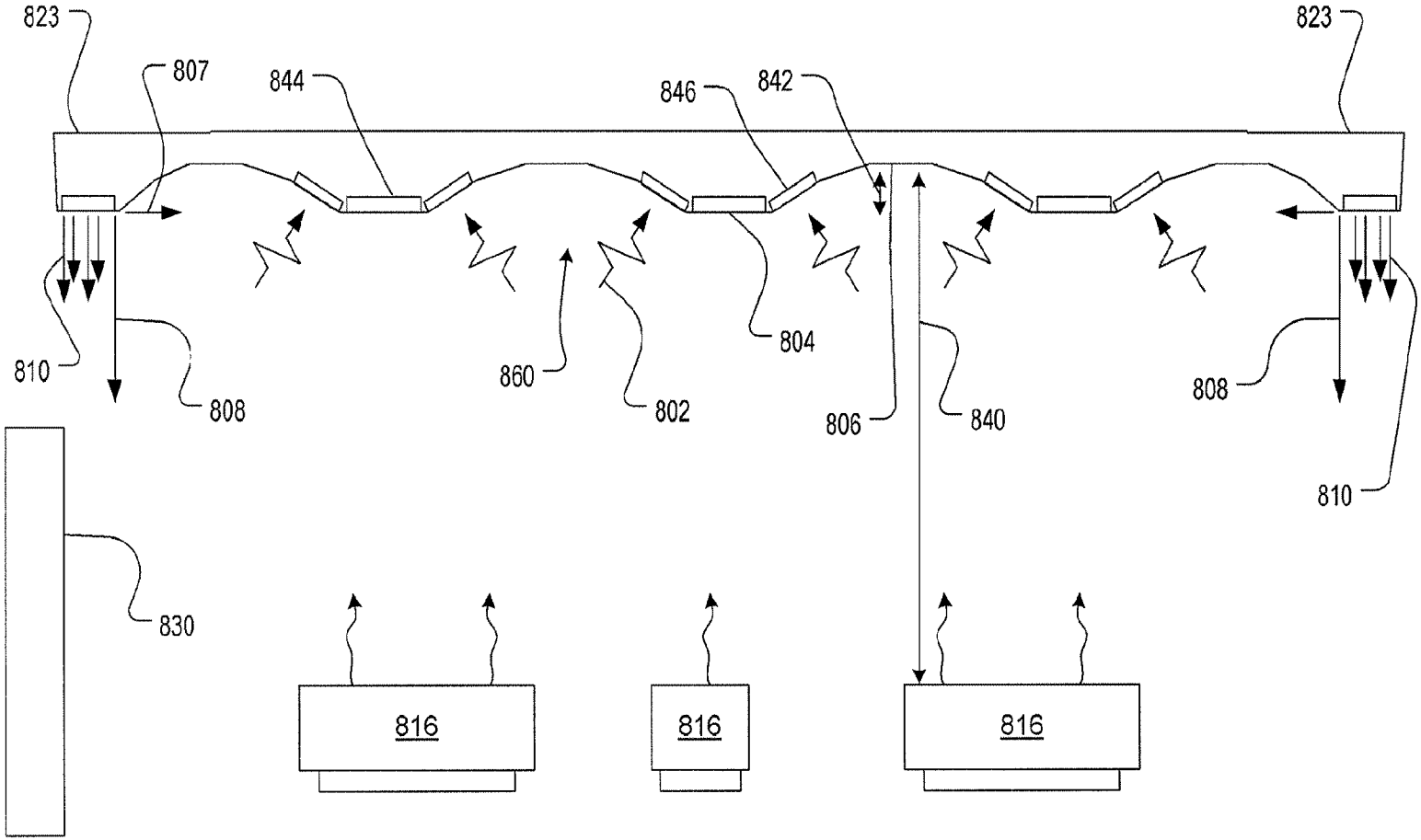
FIG. 8 shows various combinations of elements ventilation elements combined in kitchen ventilation system.

FIG. 8 shows various combinations of elements ventilation elements combined in kitchen ventilation system. Multiple recesses such as indicated at 860 cover an entire ceiling area of a kitchen thereby protecting multiple appliances 816 which can be located anywhere in the kitchen. The region covered by the multiple recesses 860 can have any number sections producing horizontal 807 and vertical 808 jets and makeup air discharges 810, such as indicated at 823. Each recess may have an exhaust inlet 846 drawing fumes as indicated at 802 thereinto. The horizontal jets can be located at various locations throughout the multiple recesses to help direct fumes to the exhaust and away from other ceiling fixtures such as the lights 804. The vertical jets 808 are preferably located to define the perimeter of the protected are. Alternatively the perimeter can be defined by a displacement ventilation register 830 or a wall (not shown).

In the present and all systems, a ventilated ceiling is distinguished from conventional hoods by being very shallow relative to the height at which it is located. Here in this case, the depth 842 of the recess 860 may be more than five time the distance 840 from the source of fumes and the blind end of the recess 860.

Note that any of the embodiments described herein may be modified by eliminating the lighting component. So wherever the term "LVD" is used, the alternative lacking a light source is also a possible embodiment.

The invention claimed is:

1. An exhaust device, comprising:

a housing having a height that is no more than one tenth of its width;

the housing having surfaces defining at least one recess having an exhaust intake within the recess for receiving fumes captured in the recess and drawing the fumes out of the recess;

the housing having a perimeter that extends around an entirety of the at least one recess, the perimeter having a jet register located below the exhaust intake and configured to generate jets along an entirety of the perimeter, a first of the jets being directed toward the exhaust intake and located below it and a second of the jets being directed substantially vertically downward;

lower edges of a portion of the housing containing the exhaust intake and portion of the housing containing the jet register being substantially vertically aligned;

the surfaces defining each of the at least one recess forming a surface with a light source located adjacent the jet register;

the first of the jets terminating at or immediately short of the exhaust intake;

the second of the jets terminating above 1.8 meters above a floor level;

a fume source located below the housing;

the light source including a light diffuser, lamp cover, or lens and being located adjacent the first of the jets, which is horizontal, so that the first of the jets keeps it clean whereby the first of the jets does double duty by helping to trap fumes by guiding pollution-containing plumes from the fume source, and keeping the light source clean; and an edge of the fume source being positioned to form at least a 20 degree angle from vertical with the jet register such that all of the fume source lies below the at least one recess.

2. The device of claim 1, further comprising:

a control system which is configured to control the first of the jets responsively to real time measured draft conditions in a space in which the housing is located.

3. The device of claim 1, further comprising:

a general ventilation register located adjacent the jet register, the general ventilation register directing ventilation air downwardly at non-mixing velocities.

4. The device of claim 1, wherein the jet register surrounds the perimeter of the housing.

5. The device of claim 1, wherein the first and second of the jets are supplied from a common plenum.

6. The device of claim 1, wherein the recess has a depth that is more than five times a distance between a blind end of the recess and the fume source.

7. The device of claim 1, wherein the recess has a depth that is more than eight times a distance between a blind end of the recess and the fume source.

8. The device of claim 1, wherein the first of the jets has a velocity of 6 to 10 m/s and a volume flow rate per linear meter of 21 to 35 cm/hr per linear meter of the jet register.

9. The device of claim 8, wherein a ratio of total volume rate of the second of the jets to total volume rate of the first of the jets is in a range of 0.25 to 0.35.

10. The device of claim 1, wherein the light source and an adjacent one of the surfaces of the housing form a substantially continuous surface.

* * * * *